US009383138B2

(12) United States Patent
Scheer et al.

(10) Patent No.: US 9,383,138 B2
(45) Date of Patent: Jul. 5, 2016

(54) METHODS AND HEAT TREATMENT APPARATUS FOR UNIFORMLY HEATING A SUBSTRATE DURING A BAKE PROCESS

(75) Inventors: Steven Scheer, Austin, TX (US); Michael A. Carcasi, Austin, TX (US)

(73) Assignee: Tokyo Electron Limited, Tokyo (JP)

( * ) Notice: Subject to any disclaimer, the term of this patent is extended or adjusted under 35 U.S.C. 154(b) by 1981 days.

(21) Appl. No.: 11/693,818

(22) Filed: Mar. 30, 2007

(65) Prior Publication Data

US 2008/0237214 A1 Oct. 2, 2008

(51) Int. Cl.
*F27D 11/00* (2006.01)
*F27B 17/00* (2006.01)

(52) U.S. Cl.
CPC ..... *F27B 17/0025* (2013.01)

(58) Field of Classification Search
USPC ..... 219/439, 428, 441; 165/80.2; 34/391, 34/638
See application file for complete search history.

(56) References Cited

U.S. PATENT DOCUMENTS

| | | | | |
|---|---|---|---|---|
| 4,910,122 | A | | 3/1990 | Arnold et al. |
| 5,158,616 | A | | 10/1992 | Kinoshita et al. |
| 5,261,431 | A | | 11/1993 | Ueno et al. |
| 5,339,539 | A | | 8/1994 | Shiraishi et al. |
| 5,350,899 | A | | 9/1994 | Ishikawa et al. |
| 5,361,787 | A | | 11/1994 | Miyazaki et al. |
| 5,369,891 | A | | 12/1994 | Kamikawa |
| 5,421,905 | A | | 6/1995 | Ueno et al. |
| 5,435,075 | A | | 7/1995 | Shiraishi et al. |
| 5,545,289 | A | | 8/1996 | Chen et al. |
| 5,598,026 | A | | 1/1997 | Kapoor et al. |
| 5,671,544 | A | | 9/1997 | Yokomizo et al. |
| 5,697,427 | A | * | 12/1997 | Ngan et al. ..... 165/80.1 |
| 5,782,990 | A | | 7/1998 | Murakami et al. |
| 5,873,177 | A | | 2/1999 | Honda et al. |
| 5,958,265 | A | * | 9/1999 | Ogahara ..... 219/121.43 |
| 6,001,191 | A | | 12/1999 | Kamikawa et al. |
| 6,096,135 | A | * | 8/2000 | Guo et al. ..... 118/729 |
| 6,112,595 | A | | 9/2000 | Stanke et al. |
| 6,119,367 | A | | 9/2000 | Kamikawa et al. |
| 6,203,627 | B1 | | 3/2001 | Shindo et al. |
| 6,218,292 | B1 | | 4/2001 | Foote |
| 6,229,116 | B1 | | 5/2001 | Shirakawa et al. |
| 6,241,827 | B1 | | 6/2001 | Tanaka et al. |

(Continued)

FOREIGN PATENT DOCUMENTS

| | | | |
|---|---|---|---|
| JP | 04319723 | A | 11/1992 |
| KR | 20070051646 | A | 5/2007 |

OTHER PUBLICATIONS

USPTO, Office Action issued in related U.S. Appl. No. 11/833,038 dated as mailed Jul. 10, 2009.

(Continued)

*Primary Examiner* — Thien S Tran
(74) *Attorney, Agent, or Firm* — Wood, Herron & Evans, LLP

(57) ABSTRACT

Methods and heat treatment apparatus for heating a substrate and any layer carried on the substrate during a bake process. A heat exchange gap between the substrate and a heated support is at least partially filled by a gas having a high thermal conductivity. The high thermal conductivity gas is introduced into the heat exchange gap by displacing a lower thermal conductivity originally present in the heat exchange gap when the substrate is loaded. Heat transfer across the heat exchange gap is mediated by the high thermal conductivity gas.

16 Claims, 5 Drawing Sheets

(56) References Cited

U.S. PATENT DOCUMENTS

| | | | | |
|---|---|---|---|---|
| 6,345,909 | B1 | 2/2002 | Yam | |
| 6,357,458 | B2 | 3/2002 | Tanaka et al. | |
| 6,394,760 | B1 | 5/2002 | Tell | |
| 6,524,389 | B1 * | 2/2003 | Katayama et al. | 118/712 |
| 6,544,338 | B1 * | 4/2003 | Batchelder et al. | 118/641 |
| 6,564,474 | B2 | 5/2003 | Nagashima | |
| 6,575,178 | B1 | 6/2003 | Kamikawa | |
| 6,575,622 | B2 | 6/2003 | Norrbakhsh et al. | |
| 6,597,964 | B1 | 7/2003 | Huang et al. | |
| 6,637,445 | B2 | 10/2003 | Ogasawara et al. | |
| 6,658,763 | B2 * | 12/2003 | Morad et al. | 34/412 |
| 6,665,952 | B2 * | 12/2003 | Nagashima | 34/391 |
| 7,017,652 | B2 | 3/2006 | Mitrovic et al. | |
| 7,063,097 | B2 | 6/2006 | Arno et al. | |
| 7,101,816 | B2 | 9/2006 | Kaushal et al. | |
| 7,141,274 | B2 | 11/2006 | Wang et al. | |
| 2002/0157960 | A1 * | 10/2002 | Dordi et al. | 205/143 |
| 2004/0154641 | A1 | 8/2004 | Montierth | |
| 2005/0199489 | A1 | 9/2005 | Stevens et al. | |
| 2005/0218003 | A1 | 10/2005 | Wang et al. | |
| 2005/0230260 | A1 | 10/2005 | Bleck et al. | |
| 2006/0097185 | A1 | 5/2006 | Mack | |
| 2006/0130750 | A1 | 6/2006 | Ishikawa et al. | |
| 2007/0178404 | A1 | 8/2007 | Brodsky et al. | |
| 2008/0081111 | A1 | 4/2008 | Carcasi | |
| 2008/0160462 | A1 | 7/2008 | Herchen et al. | |
| 2008/0241400 | A1 | 10/2008 | Scheer et al. | |

OTHER PUBLICATIONS

USPTO, Office Action issued in related U.S. Appl. No. 11/537,622 dated Mar. 5, 2010.

USPTO, final Office Action issued in related U.S. Appl. No. 11/537,622 dated Aug. 9, 2010.

USPTO, Notice of Allowance issued in U.S. Appl. No. 11/537,622 dated Mar. 11, 2013.

* cited by examiner

METHODS AND HEAT TREATMENT APPARATUS FOR UNIFORMLY HEATING A SUBSTRATE DURING A BAKE PROCESS

FIELD OF THE INVENTION

The invention relates to methods and heat treatment apparatus for thermally processing substrates, such as semiconductor wafers.

BACKGROUND OF THE INVENTION

Photolithography processes for manufacturing semiconductor devices and liquid crystal displays (LCD's) generally coat a resist on a substrate, expose the resist coating to light to impart a latent image pattern, and develop the exposed resist coating to transform the latent image pattern into a final image pattern having masked and unmasked areas. Such a series of processing stages is typically carried out in a coating/developing system having discrete heating sections, such as a pre-baking unit and a post-baking unit. Each heating section of the coating/developing system may incorporate a hotplate with a built-in heater of, for example, a resistance heating type.

Feature sizes of semiconductor device circuits have been scaled to less than 0.1 micron. Typically, the pattern wiring that interconnects individual device circuits is formed with sub-micron line widths. Consequently, the heat treatment temperature of the resist coating should be accurately controlled to provide reproducible and accurate feature sizes and line widths. The substrates or wafers (i.e., objects to be treated) are usually treated or processed under the same recipe (i.e., individual treatment program) in units (i.e., lots) each consisting of, for example, twenty-five wafers. Individual recipes define heat treatment conditions under which pre-baking and post-baking are performed. Wafers belonging to the same lot are heated under the same conditions.

According to each of the recipes, the heat treatment temperature may be varied within such an acceptable range that the temperature will not have an effect on the final semiconductor device. In other words, a desired temperature may differ from a heat treatment temperature in practice. When the wafer is treated with heat beyond the acceptable temperature range, a desired resist coating cannot be obtained. Therefore, to obtain the desired resist coating, a temperature sensor is used for detecting the temperature of the hotplate. On the basis of the detected temperature, the power supply to the heater may be controlled with reliance on feedback from the temperature sensor. Because the temperature of the entire hotplate is not uniform and varies with the lapsed time, however, it is difficult to instantaneously determine the temperature of the hotplate using a single temperature sensor.

The post exposure bake (PEB) process is a thermally activated process and serves multiple purposes in photoresist processing. First, the elevated temperature of the bake drives the diffusion of the photoproducts in the resist. A small amount of diffusion may be useful in minimizing the effects of standing waves, which are the periodic variations in exposure dose throughout the depth of the resist coating that result from interference of incident and reflected radiation. Another main purpose of the PEB is to drive an acid-catalyzed reaction that alters polymer solubility in many chemically amplified resists. PEB also plays a role in removing solvent from the wafer surface.

Chemical amplification allows a single photoproduct to cause many solubility-switching reactions, thus increasing the sensitivity of these photoresist systems. Some amount of acid transport is necessary in that it allows a single acid to move to many reactive polymer sites. However, acid transport from nominally exposed to unexposed regions can complicate control of resist feature dimensions. Acid transport through these reactive systems is mechanistically complex. Measurements have shown that there is a very large difference in acid mobility between the starting material, which is reactive towards acid, and the product material, which is no longer reactive.

In addition to the intended results, numerous problems may be observed during heat treatment. For example, the light sensitive component of the resist may decompose at temperatures typically used to remove the solvent, which is a concern for a chemically amplified resist because the remaining solvent content has a strong impact on the diffusion and amplification rates. Also, heat-treating can affect the dissolution properties of the resist and, thus, have direct influence on the developed resist profile.

Hot plates having uniformities within a range of a few tenths of a degree centigrade are currently available and are generally adequate for current process methods. Hotplates may be calibrated using a flat bare silicon wafer with imbedded thermal sensors. However, actual production wafers carrying deposited films on the surface of the silicon may exhibit small amounts of warpage because of the stresses induced by the deposited films. This warpage may cause the normal gap between the wafer and the hotplate (referred to as the proximity gap), to vary across the wafer from a normal value of approximately 100 μm by as much as a 100 μm deviation from the mean proximity gap. Consequently, actual production wafers may have different heating profiles than the wafer used to calibrate the hotplate.

This variability in the proximity gap changes the heat transfer characteristics in the area of the varying gap. Heat transfer through gases with low thermal conductivity, such as air, in the gap can cause temperature non-uniformity across the wafer surface as the temperature of the wafer is elevated to a process temperature. This temperature non-uniformity may result in a change in critical dimension (CD) in that area of several nanometers, which can approach the entire CD variation budget for current leading edge devices, and will exceed the projected CD budget for smaller devices planned for production in the next few years.

What is needed, therefore, are apparatus and methods for heating a substrate during a thermal processing system that are tolerant of variances in the proximity gap.

SUMMARY OF THE INVENTION

In an embodiment, a method for heating a substrate inside a processing chamber comprises supporting the substrate in a spaced relationship with a support surface in a first gas at approximately atmospheric pressure inside the processing chamber. The backside of the substrate is separated from the support surface by a heat exchange gap. The first gas is displaced from the heat exchange gap by a second gas having a higher thermal conductivity than the first gas to increase the thermal conductance between the substrate and the support surface. Heat energy is transferred from the support surface through the second gas in the heat exchange gap to the backside of the substrate for heating the substrate. As a result of the increased thermal conductivity, heat energy is conducted through the gap faster, minimizing temperature non-uniformity across the wafer and resulting in a more uniform heating of the wafer.

In another embodiment, a heat treatment apparatus is provided for heating a substrate. The heat treatment apparatus comprises a processing chamber containing a process space, a substrate support in the process space, and a gas supply in fluid communication with the process space. The substrate support is configured to support the substrate in the process space in a spaced relationship with a support surface and, thereby, defines a heat exchange gap between the support surface and the substrate. The gas supply is configured to supply a second gas effective to displace a first gas from the heat exchange gap. A heating element is coupled with the substrate support. The heating element is configured to heat the substrate by heat transfer through the second gas in the heat exchange gap.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

An embodiment of the method for thermally processing substrates utilizes the coating/developing process system 150. The substrate, generally in the form of a wafer composed of semiconducting material, is processed by the system 150. The processing is accomplished in such a way that the finished product will carry device structures on the top surface of the substrate.

Figure 1:
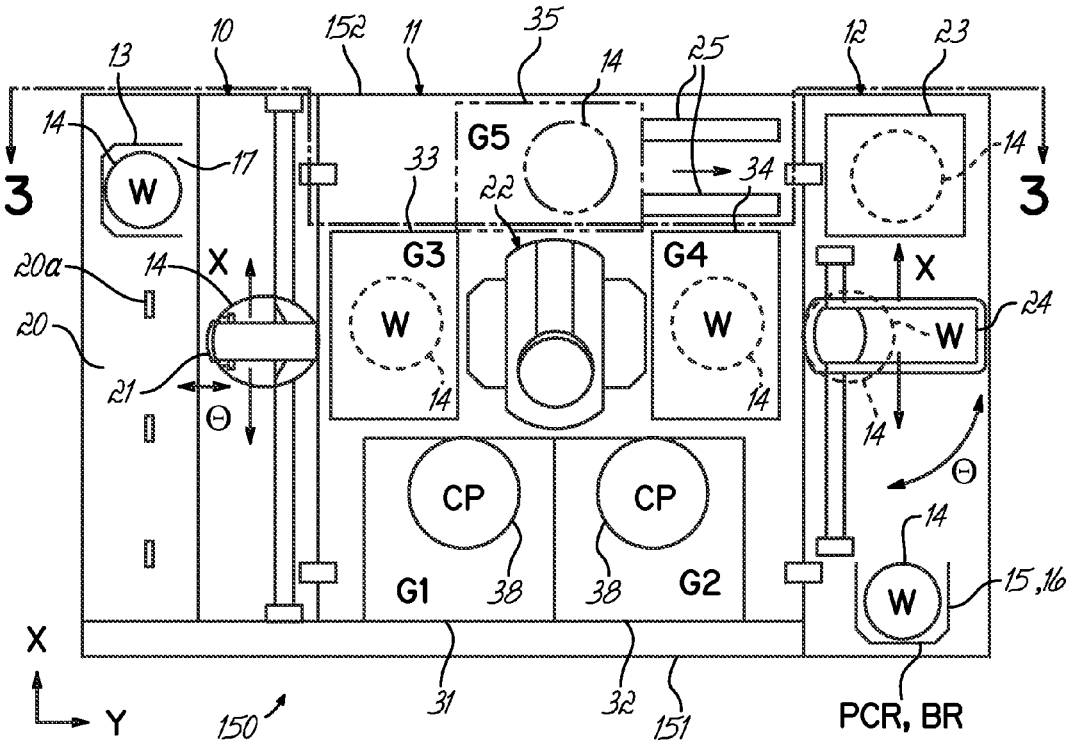
FIG. 1 is a top view of a schematic diagram of a coating/developing system for use in association with the invention.
Figure 2:
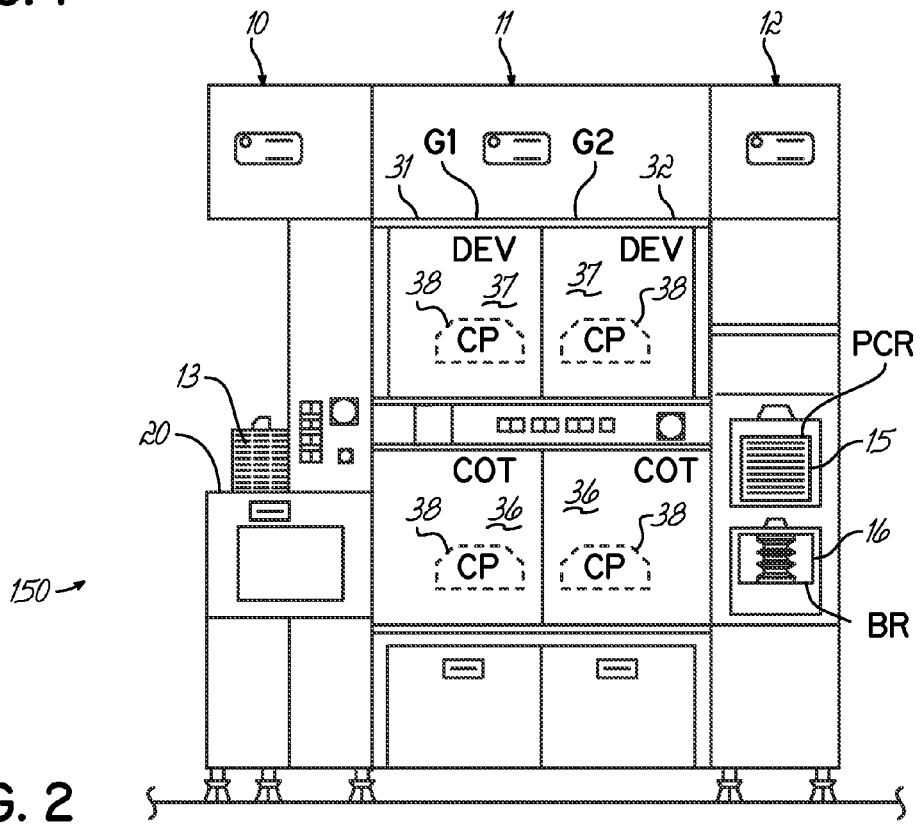
FIG. 2 is a front view of the coating/developing system of FIG. 1.
Figure 3:
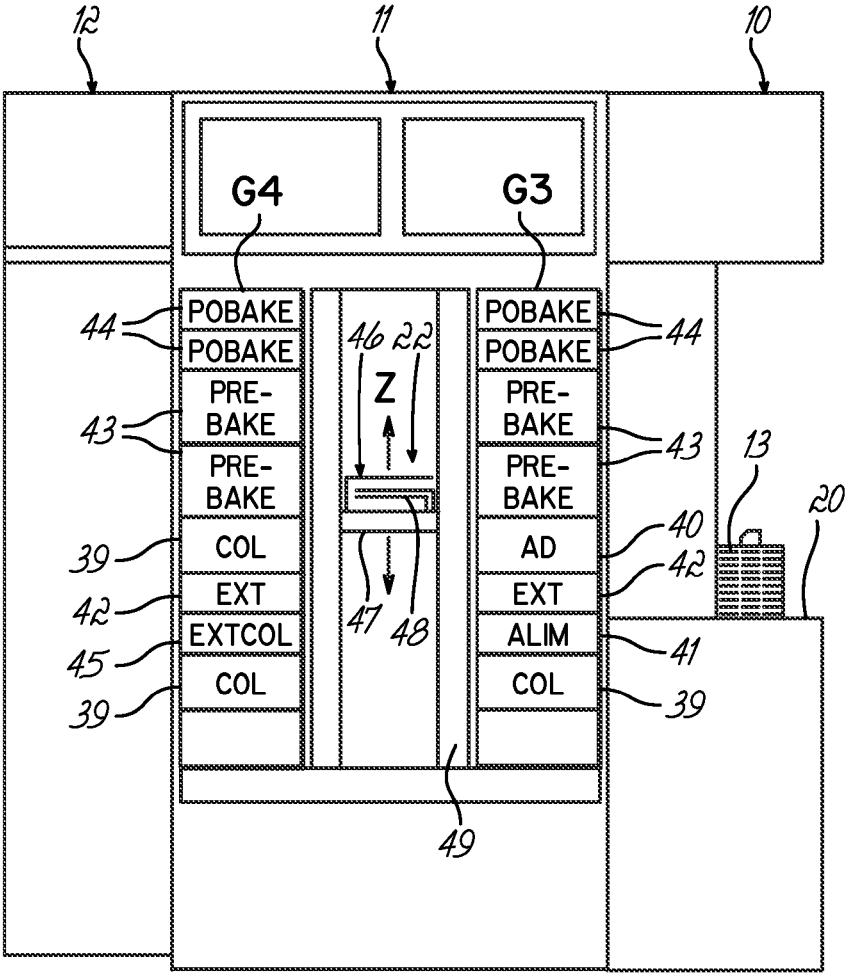
FIG. 3 is a partially cut-away back view of the coating/developing system of FIG. 1.

With reference to FIGS. 1-3, the coating/developing process system 150 comprises a cassette station 10, a process station 11, and an interface section 12, which are contiguously formed as one unit. In the cassette station 10, a cassette (CR) 13 storing a plurality of substrates represented by wafers (W) 14 (e.g., 25 wafers) is loaded into, and unloaded from, the system 150. Each of the wafers 14 can be composed of a semiconductor material such as silicon, which may have the form of a single crystal material of the kind used in the art of semiconductor device manufacturing.

The process station 11 includes various single-wafer processing units for applying a predetermined treatment required for a coating/developing step to individual wafers (W) 14. These process units are arranged in predetermined positions of multiple stages, for example, within first (G1), second (G2), third (G3), fourth (G4) and fifth (G5) multiple-stage process unit groups 31, 32, 33, 34, 35. The interface section 12 delivers the wafers (W) 14 between the process station 11 and an exposure unit (not shown) that can be abutted against the process station 11.

A cassette table 20 of cassette station 10 has positioning-projections 20*a* on which a plurality of wafer cassettes (CR) 13 (for example, at most 6) is mounted. The wafer cassettes (CR) 13 are thereby aligned in line in the direction of an X-axis (the up-and-down direction of FIG. 1) with a wafer inlet/outlet 17 facing the process station 11. The cassette station 10 includes a wafer transfer carrier 21 movable in the aligning direction (X-axis) of cassettes 13 and in the aligning direction (Z-axis, vertical direction) of wafers 14 stored in the wafer cassette (CR) 13. The wafer transfer carrier 21 gains access selectively to each of the wafer cassettes (CR) 13.

The wafer transfer carrier 21 is further designed rotatable in a Θ (theta) direction, so that it can gain access to an alignment unit (ALIM) 41 and an extension unit (EXT) 42 belonging to a third multiple-stage process unit group (G3) 33 in the process station 11, as described later.

The process station 11 includes a main wafer transfer mechanism 22 (movable up-and-down in the vertical direction) having a wafer transfer machine 46. All process units are arranged around the main wafer transfer mechanism 22, as shown in FIG. 1. The process units may be arranged in the form of multiple stages G1, G2, G3, G4 and G5.

The main wafer transfer mechanism 22 has a wafer transfer machine 46 that is movable up and down in the vertical direction (Z-direction) within a hollow cylindrical supporter 49, as shown in FIG. 3. The hollow cylindrical supporter 49 is connected to a rotational shaft of a motor (not shown). The cylindrical supporter 49 can be rotated about the shaft synchronously with the wafer transfer machine 46 by the driving force of the motor rotation. Thus, the wafer transfer machine 46 is rotatable in the Θ direction. Note that the hollow cylindrical supporter 49 may be connected to another rotational axis (not shown), which is rotated by a motor.

The wafer transfer machine 46 has a plurality of holding members 48 which are movable back and forth on a table carrier 47. The wafer (W) 14 is delivered between the process units by the holding members 48.

In the process unit station 11 of this embodiment, five process unit groups G1, G2, G3, G4, and G5 may be sufficiently arranged. For example, first (G1) and second (G2) multiple-stage process unit groups 31, 32 are arranged in the front portion 151 (in the forehead in FIG. 1) of the system 150. A third multiple-stage process unit group (G3) 33 is abutted against the cassette station 10. A fourth multiple-stage process unit group (G4) is abutted against the interface section 12. A fifth multiple-stage process unit group (G5) can be optionally arranged in a back portion 152 of system 150.

As shown in FIG. 2, in the first process unit group (G1) 31, two spinner-type process units, for example, a resist coating unit (COT) 36 and a developing unit (DEV) 37, are stacked in the order mentioned from the bottom. The spinner-type process unit used herein refers to a process unit in which a predetermined treatment is applied to the wafer (W) 14 mounted on a spin chuck (not shown) placed in a cup (CP) 38. Also, in the second process unit group (G2) 32, two spinner process units such as a resist coating unit (COT) 36 and a developing unit (DEV) 37, are stacked in the order mentioned from the bottom. It is preferable that the resist coating unit (COT) 36 be positioned in a lower stage from a structural point of view and to reduce maintenance time associated with the resist-solution discharge. However, if necessary, the coating unit (COT) 36 may be positioned in the upper stage.

As shown in FIG. 3, in the third process unit group (G3) 33, open-type process units, for example, a cooling unit (COL) 39 for applying a cooling treatment, an alignment unit (ALIM) 41 for performing alignment, an extension unit (EXT) 42, an adhesion unit (AD) 40 for applying an adhesion treatment to increase the deposition properties of the resist, two pre-baking units (PREBAKE) 43 for heating a wafer 14 before light-exposure, and two post-baking units (POBAKE) 44 for heating a wafer 14 after light exposure, are stacked in eight stages in the order mentioned from the bottom. The open type process unit used herein refers to a process unit in which a predetermined treatment is applied to a wafer 14 mounted on a support platform within one of the processing units. Similarly, in the fourth process unit group (G4) 34, open type process units, for example, a cooling unit (COL) 39, an extension/cooling unit (EXTCOL) 45, an extension unit (EXT) 42, another cooling unit (COL), two pre-baking units (PREBAKE) 43 and two post-baking units (POBAKE) 44 are stacked in eight stages in the order mentioned from the bottom.

Because the process units for low-temperature treatments, such as the cooling unit (COL) 39 and the extension/cooling unit (EXTCOL) 45, are arranged in the lower stages and the process units for higher-temperature treatments, such as the pre-baking units (PREBAKE) 43 and the post-baking units (POBAKE) 44 and the adhesion unit (AD) 40 are arranged in the upper stages in the aforementioned unit groups, thermal interference between units can be reduced. Alternatively, these process units may be arranged differently.

The interface section 12 has the same size as that of the process station 11 in the X direction but shorter in the width direction. A movable pickup cassette (PCR) 15 and an unmovable buffer cassette (BR) 16 are stacked in two stages in the front portion of the interface section 12, an optical edge bead remover 23 is arranged in the back portion, and a wafer carrier 24 is arranged in the center portion. The wafer transfer carrier 24 moves in the X- and Z-directions to gain access to both cassettes (PCR) 15 and (BR) 16 and the optical edge bead remover 23. The wafer carrier 24 is also designed rotatable in the Θ direction; so that it can gain access to the extension unit (EXT) 42 located in the fourth multiple-stage process unit group (G4) 34 in the process station 11 and to a wafer deliver stage (not shown) abutted against the exposure unit (not shown).

In the coating/developing process system 150, the fifth multiple-stage process unit group (G5, indicated by a broken line) 35 is designed to be optionally arranged in the back portion 152 at the backside of the main wafer transfer mechanism 22, as described above. The fifth multiple-stage process unit group (G5) 35 is designed to be shifted sideward along a guide rail 25 as viewed from the main wafer transfer mechanism 22. Hence, when the fifth multiple-stage process unit group (G5) 35 is positioned as shown in FIG. 1, a sufficient space is obtained by sliding the fifth process unit group (G5) 35 along the guide rail 25. As a result, a maintenance operation to the main wafer transfer mechanism 22 can be easily carried out from the backside. To maintain the space for maintenance operation to the main wafer transfer mechanism 22, the fifth process unit group (G5) 35 may be not only slid linearly along the guide rail 25 but also shifted rotatably outward in the system.

The baking process performed by the adhesion unit (AD) 40 is not as sensitive to warpage of the wafer 14 as are the pre- and post-bake processes performed by the pre-baking units (PREBAKE) 43 and the post-baking units (POBAKE) 44. Therefore, the adhesion unit (AD) 40 may continue to utilize a hotplate in the heat treatment apparatus, as disclosed in U.S. Pat. No. 7,101,816 to Kaushal et al. ("Kaushal"), which is hereby incorporated by reference herein in its entirety. Nevertheless, in embodiments of the invention, the adhesion unit (AD) 40 may also utilize any of the embodiments of the heat treatment apparatus described below.

Figure 4:
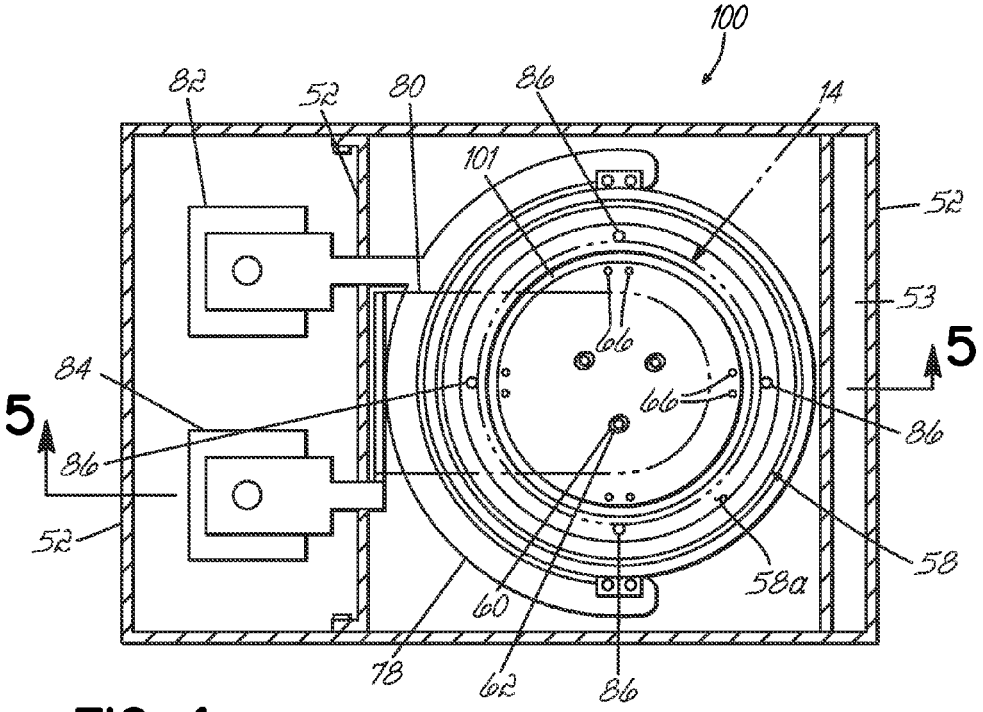
FIG. 4 is a top view of a heat treatment apparatus for use with the coating/developing system of FIGS. 1-3.
Figure 5:
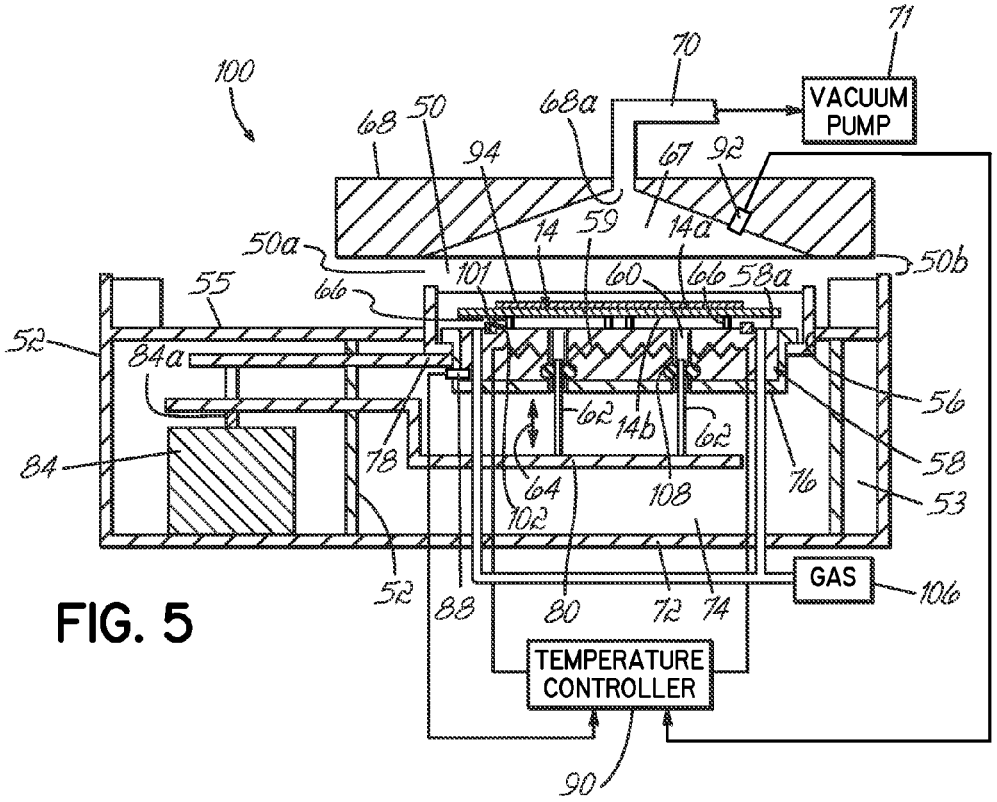
FIG. 5 is a cross-sectional view of the heat treatment apparatus of FIG. 4 generally along line 5-5.
Figure 6:
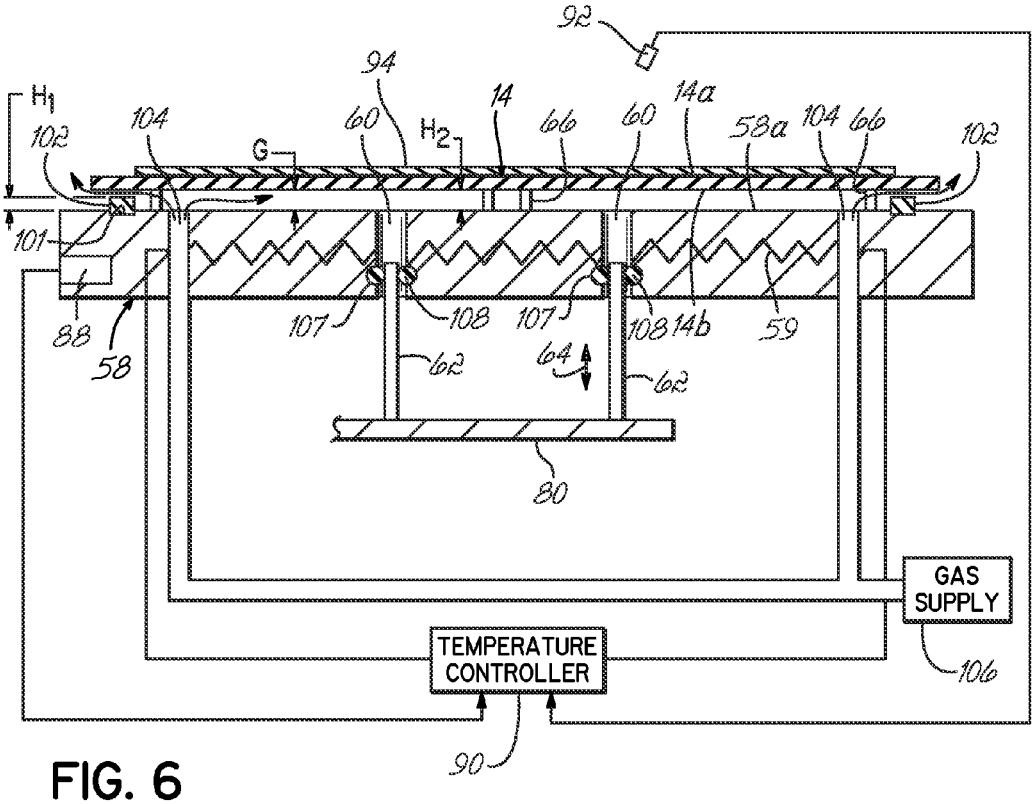
FIG. 6 is an enlarged view of a portion of FIG. 5.

With reference to FIGS. 4-6, the pre-baking unit (PREBAKE) 43 or the post-baking unit (POBAKE) 44 may comprise a heat treatment apparatus 100 in which wafers 14 are heated to temperatures above room temperature. Each heat treatment apparatus 100 includes a processing chamber 50, a substrate support in the representative form of a hotplate 58, and a heating element 59 contained in the hotplate 58. The wafer 14 includes a front surface 14*a* (also referred to herein as the "front side") and a rear surface 14*b* (also referred to herein as the "backside").

The heating element 59 of the hotplate 58 may comprise, for example, a resistance-heating element. A temperature-sensing element 88, such as a thermistor, a thermocouple, or a resistance temperature detector (RTD), may be thermally coupled with the hotplate 58. The temperature-sensing element 88 is electrically coupled with a temperature controller 90. The temperature controller 90 is also electrically coupled with the heating element 59 and powers the heating element 59 to generate heat energy used to elevate the temperature of the hotplate 58. The temperature-sensing element 88 may provide feedback to a temperature controller 90 for optimizing the temperature setting or the uniformity of the temperature distribution across the wafer 14 supported by the hotplate 58, which may include different temperature zones as disclosed in Kaushal.

As the heating element 59 elevates the temperature of the hotplate 58, heat energy from the hotplate 58 is conducted through the gap G, which then heats the wafer 14. The temperature of the wafer 14 may be inferred from the measured hotplate temperature or may be measured directly using a temperature sensor 92 such as, for example, a pyrometer. The temperature sensor 92, which is also electrically coupled with the temperature controller 90, may sample the temperature on a front-side 14*a* of the wafer 14. Alternatively, the temperature sensor 92 may be configured to detect the temperature at the backside 14*b* of the wafer 14 by sampling through an aperture (not shown) in the hotplate 58. A direct contact approach of wafer temperature measurement may also be used, for example, by bringing the temperature sensor 92 into close proximity to the backside 14*b* of the wafer 14.

The hotplate 58 has a plurality of passageways 60 and a plurality of lift pins 62 projecting into the passageways 60. The lift pins 62 are moveable between a first lowered position where the pins are flush or below the upper support surface 58*a* of hotplate 58 to a second lifted position where the lift pins project above the upper support surface 58*a* of hotplate 58. When the lift pins 62 are in the first lowered position, they do not contact the backside 14*b* of the wafer 14. The lift pins 62 are connected to and supported by an arm 80 which is further connected to, and supported by, a rod 84*a* of a vertical cylinder 84. When the rod 84*a* is actuated by the vertical cylinder 84 to protrude from the vertical cylinder 84, the lift pins 62 are moved from the first lowered position to the second lifted position, contacting the backside 14*b* of the wafer 14 and thereby lifting the wafer 14.

With continued reference to FIGS. 4 and 5, the processing chamber 50 includes a sidewall 52, a lid 68, and a horizontal shielding plate 55 that defines a base with which the lid 68 is engaged. When engaged with the shielding plate 55, the lid 68 defines a process space 67 filled by a gaseous environment when lid 68 is united with the horizontal shielding plate 55. Gaps 50*a*, 50*b* are formed at a front surface side (aisle side of the main wafer transfer mechanism 22) and a rear surface side of the processing chamber 50, respectively. The wafer 14 is loaded into and unloaded from the processing chamber 50 through the gaps 50*a*, 50*b*. A circular opening 56 is formed at the center of the horizontal shielding plate 55. The hotplate 58 is housed in the opening 56. The hotplate 58 is supported by the horizontal shielding plate 55 with the aid of a supporting plate 76. The supporting plate 76, shutter arm 78, lift pin arm 80, and liftable cylinders 82, 84 are arranged in a compartment 74. The compartment 74 is defined by the shielding plate 55, two sidewalls 53, and a bottom plate 72.

A ring-form shutter (not shown) may be attached to the outer periphery of the hotplate 58. Injection openings (not shown) are formed along the periphery of the shutter at constant or varying intervals of central angles. The injection openings communicate with a cooling gas supply source (not shown). The shutter may be liftably supported by a cylinder 82 via a shutter arm 78. When the shutter is raised, a cooling gas, such as nitrogen gas or air, is exhausted from the injection openings, which is used to drop the temperature of the wafer 14 below the reaction temperature quickly while the wafer 14 is waiting to be picked up and moved to the next stage of processing. In an alternative embodiment, a cooling arm may be attached to a cooling plate that moves in when the wafer 14 is finished processing. The wafer 14 then sits on the cooling plate until it's ready to be picked up. The cooling plate may be cooled by chilled water.

The wafers 14 each carry a layer 94 of processable material, such as resist. The layer 94 may contain a substance that is volatized and released at the process temperature. The resist coating unit (COT) 36 may be used to apply the layer 94 that is thermally processed in a subsequent process step by a thermal processing apparatus 100 at the process temperature. This volatile substance evaporates off of the wafer 14 when the layer 94 is exposed to the heat energy produced by the hotplate 58 at a temperature sufficient to heat the wafer 14 and layer 94 to the process temperature. An exhaust port 68*a* at the center of the lid 68 communicates with an exhaust pipe 70. Waste products generated from the front-side 14*a* of the wafer 14 at the process temperature are exhausted through the exhaust port 68*a* and vented from the processing chamber 50 via exhaust pipe 70 to a vacuum pump 71, or other evacuation unit, that can be throttled to regulate the exhaust rate.

With reference to FIG. 4, projections 86 are arranged as alignment pins on the upper support surface 58*a* of the hotplate 58 and are used for accurately and reproducibly positioning the wafer 14 on hotplate 58. Shorter support protrusions 66 define proximity pins that project from the upper support surface 58*a* of the hotplate 58. The support protrusions 66 bear the mass or weight of the wafer 14 so as to support wafer 14 during thermal processing. When the wafer 14 is mounted on the hotplate 58, top portions of the support protrusions 66 have a contacting relationship with the backside 14*b* of wafer 14, which is in a spaced relationship with the confronting support surface 58*a* on the hotplate 58. When supported on the support protrusions 66, the lift pins 62 have a non-contacting relationship with the backside 14*b*. A narrow heat exchange gap G is formed between the backside 14*b* of the wafer 14 and the upper support surface 58*a* of the hotplate 58. The width of the gap G may be approximately equal to the height $H_2$ of the support protrusions 66. The gap G prevents the backside 14*b* of the wafer 14 from being strained and damaged by contact with the support surface 58*a* on the hot plate 58.

After the wafer 14 is mounted on the hotplate 58, the gap G primarily contains a first gas, which may be a mixture of gaseous elements, such as air, or predominantly a single element, such as nitrogen. A second gas, such as hydrogen or helium, with a higher thermal conductivity than the first gas may be introduced into the gap G between the wafer 14 and the hotplate 58, to increase the thermal conductance in the gap G. Thermal conductance is the quantity of heat transmitted per unit time from a unit of surface of material to an opposite unit of surface material under a unit temperature differential between the surfaces. As the high thermal conductivity gas is introduced into the gap G, it displaces the first gas causing the first gas to flow out of the gap G. A loose seal may be formed between a sealing member 102, such as an o-ring (FIG. 6), and the rear surface 14*b* of the wafer 14. The sealing member 102 assists in keeping the high thermal conductivity gas contained in the gap G and inhibits any reentry of the first gas back into the gap G.

Heat energy from the hotplate 58 is conducted through the high thermal conductivity gas in the gap G to the wafer 14. The thermal conductivity represents a measure of solid material to conduct heat. The thermal conductivity of the material forming the wafer 14 is sufficient to transfer heat from the backside 14*b* to the front-side 14*a* of the wafer 14. The higher thermal conductivity of the gas makes the system less sensitive to warpage in the wafer 14 by compensating for variations in flatness than modulate the width of gap G. For example, a system with air in the gap G between the wafer 14 and the hotplate 58 may produce about a 1° C. temperature gradient in different parts of the wafer 14 due to warpage. The temperature gradient may be reduced to about 0.17° C. by replacing the air, or other low conductivity gas, in the gap G with the high thermal conductivity gas such as helium, which has a thermal conductivity of almost six times greater than the thermal conductivity of air.

The hotplate 58 further includes a groove 101 in the hotplate 58 and a sealing member 102, such as an o-ring, placed in the groove 101, as best shown in FIG. 6. The wafer 14 is delivered to the processing chamber 50, as discussed above, and lift pins 62 lower the wafer 14 as shown diagrammatically by arrow 64 (FIG. 5). The wafer 14 is guided into position by projections 86 in proximity to the sealing member 102 and is supported above the hotplate 58 on support protrusions 66 where the backside 14*b* of the wafer 14 contacts a top of the support protrusions 66. The height $H_1$ of the sealing member 102 relative to the upper support surface 58*a* of hotplate 58 may be slightly shorter than the height $H_2$ of the support protrusions 66 to assist the high thermal conductivity gas in displacing the air, or other low thermal conductivity gas, in the gap G. The difference in height $H_1$ and height $H_2$ results in a loose seal or dam being formed between an outer perimeter of the wafer 14 and the sealing member 102 as best seen in FIG. 6. The loose seal allows gases from the gap G between the wafer 14 and the hotplate 58 to escape from beneath the wafer 14 by passing between the sealing member 102 and the wafer 14, while inhibiting gases from the processing chamber 50 from moving back into the gap G.

The high thermal conductivity gas is introduced into gap G through delivery passageways 104 in the hotplate 58. The delivery passageways 104 communicate with a high thermal conductivity gas supply 106. The air, or other low thermal conductivity gas, in the gap G is displaced as the high thermal conductivity gas from the gas supply 106 is delivered into the gap G. The resulting gaseous environment in the gap G between the backside 14*b* of the wafer 14 and upper support surface 58*a* of the hotplate 58 is primarily composed of the high thermal conductivity gas, which increases the thermal conductance in the gap G. The high thermal conductivity gas need not displace all of the air in the gap G. However, a gaseous environment in the gap G containing higher concentrations of the high thermal conductivity gas than air, or other low thermal conductivity gas, will promote greater heat transfer and thermal conductance between the hotplate 58 and the wafer 14. In alternate embodiments, the delivery passageways 104 may supply a continuous flow of high thermal conductivity gas to displace the air in the gap G. The continuous flow of the high thermal conductivity gas prevents air, or other low thermal conductivity gas, from re-entering and filling the gap G.

Each of the passageways 60 includes a ring-shaped groove 107 in a sidewall surrounding each passageway 60 and a seal member 108 in the groove 61 that creates a pressure seal between one of the lift pins 62 and its respective passageway 60 at least when the lift pins 62 are retracted into the hotplate 58 to the first lowered position. The seal members 108 prevent or significantly restrict the flow of the high thermal conductivity gas through the passageways 60 and out of the gap G. Likewise, sealing the passageways 60 inhibits the flow of air back into the gap G. Alternatively, each of the lift pins 62 may carry a seal member (not shown) that provides a seal with the corresponding passageway 60 as a substitute for seal members 108.

Figure 7:
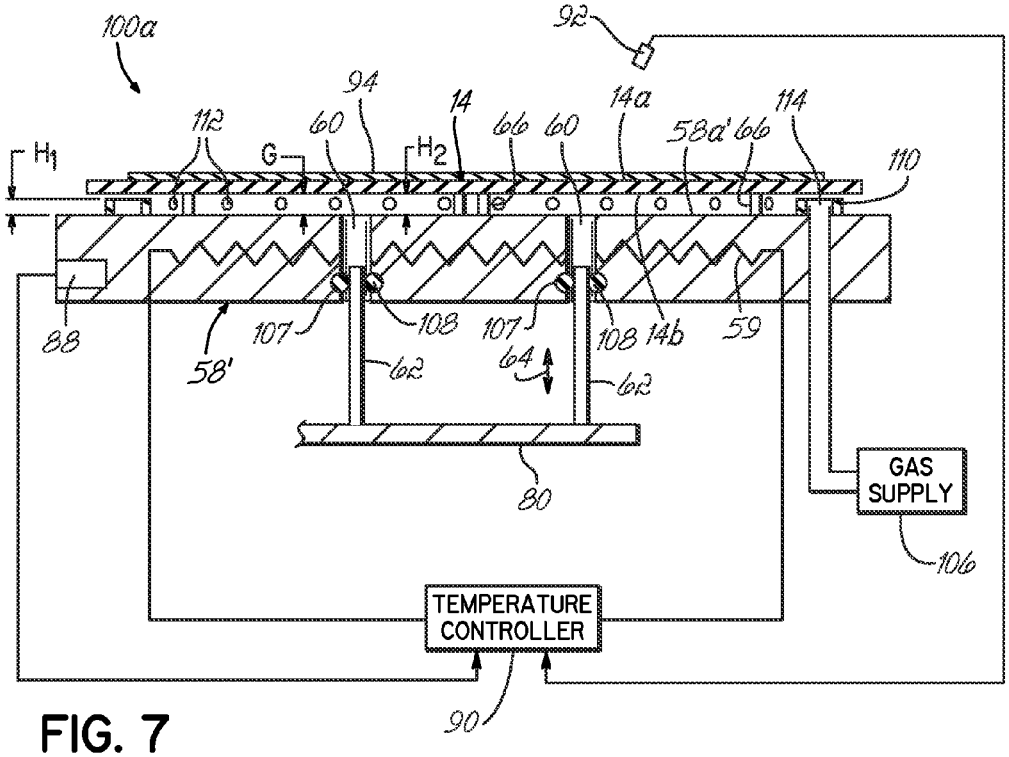
FIG. 7 is a cross-sectional view similar to FIG. 6 of an alternative embodiment of a heat treatment apparatus in which the high thermal conductivity gas is delivered through the walls of a side purge ring.

With reference to FIG. 7 in which like reference numerals refer to like features in FIGS. 4-6 and in accordance with an embodiment of the invention, a heat treatment apparatus 100*a* includes a side purge ring 110 that forms a loose seal with the wafer 14 enclosing the gap G between the wafer 14 and the hotplate 58. The high thermal conductivity gas is introduced into the gap G through holes 112 in the side purge ring 110. The holes 112 communicate with passageway 114, which in turn communicates with a source of high thermal conductivity gas in the form of gas supply 106. The high thermal conductivity gas flows from the holes 112 into the gap G displacing the air. The resulting gaseous environment in the gap G between the backside 14*b* of the wafer 14 and upper support surface 58*a* of the hotplate 58 may be composed of a high concentration of the high thermal conductivity gas, which increases the thermal conductance in the gap G. The high thermal conductivity gas need not displace all of the air in the gap G. However, as with the previous embodiment, a gaseous environment in the gap G containing higher concentrations of the high thermal conductivity gas than air will achieve better thermal conduction between the hotplate 58 and the wafer 14. In alternate embodiments, the side purge ring 110 may supply a continuous flow of high thermal conductivity gas to displace the air in the gap G. The continuous flow of the high thermal conductivity gas may prevent air from re-filling the gap G.

Similar to the embodiment described above and shown in FIG. 6, when the lift pins 62 are retracted into the hotplate 58, the passageways 60 through which the lift pins 62 translate may be sealed with the o-ring 108 to inhibit the flow of the high thermal conductivity gas through the passageways 60 and out of the gap G. Likewise, as above, the o-ring 108 may also inhibit the flow of air back into the gap G through the passageways 60.

Figure 8:
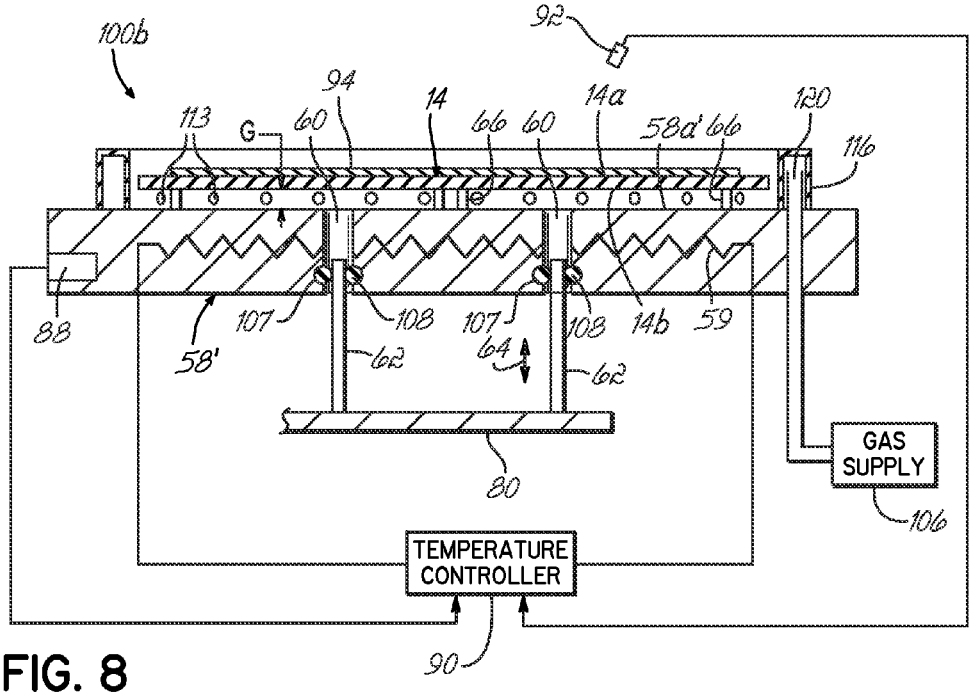
FIG. 8 is a cross-sectional view similar to FIGS. 6 and 7 of an alternative embodiment with the high thermal conductivity gas being delivered through the walls of a side purge ring.

With reference to FIG. 8 in which like reference numerals refer to like features in FIGS. 4-7 and in accordance with an embodiment of the invention, a heat treatment apparatus 100*b* further includes a side purge ring 116 that surrounds the wafer 14 and gap G. High thermal conductivity gas is introduced through holes 113 into the gap G displacing the air in the gap, which increases the thermal conductance in the gap G. The side purge ring 116 may form a loose seal allowing the air to pass between the side purge ring 116 and the wafer 14. In alternate embodiments, the side purge ring 116 may supply a continuous flow of high thermal conductivity gas to displace the air in the gap G. The continuous flow of the high thermal conductivity gas prevents air from re-filling the gap G. Similar to the holes 112 of the embodiment in FIG. 7, the holes 113 communicate with a channel 120 in the side purge ring 116 that communicates with a source of high thermal conductivity gas in the form of gas supply 106.

Figure 9:
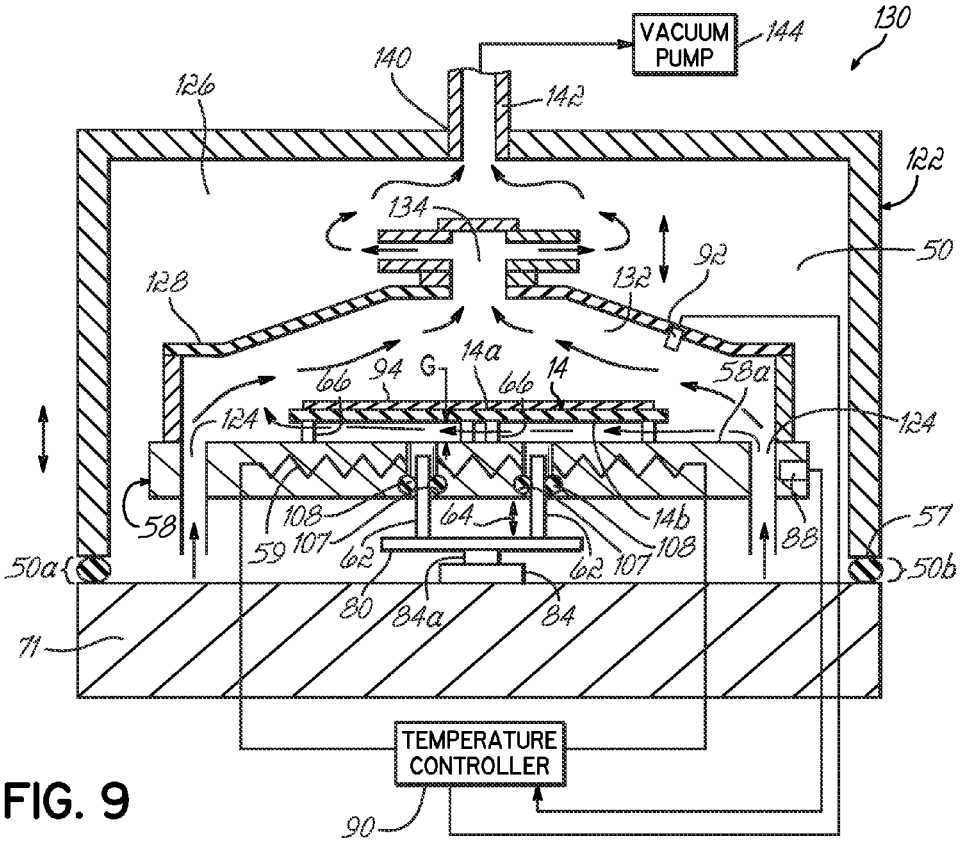
FIG. 9 is a cross-sectional view of an alternate embodiment where the high thermal conductivity gas fills the processing chamber.

With reference to FIG. 9 in which like reference numerals refer to like features in FIGS. 4-8 and in accordance with an embodiment of the invention, a heat treatment apparatus 130 includes a gaseous environment in a process space 132 inside a processing chamber 50 in which the wafer 14 is heated. The heat treatment apparatus 130 has a thick plate 71 and a cover 122, which moves vertically and forms processing chamber 50 integrally with the thick plate 71. A temperature controller 90 controls a heating element 59 embedded in the hotplate 58. Accordingly, the power supplied to the heating element 59 can be controlled at a set temperature determined by the temperature controller 90, and the temperature of the hotplate 58 can be maintained at the set temperature, as with the hotplate disclosed in Kaushal.

When the cover 122 is lifted away from the thick plate 71, opening gaps 50*a*, 50*b*, the wafer 14 is loaded into and unloaded from the processing chamber 50 through the gaps 50*a*, 50*b*. The hotplate 58 contains passageways 60 and lift pins 62 inserted into the passageways 60. The lift pins 62 are connected to, and supported by, an arm 80 which is further connected to and supported by a rod 84*a* of a vertical cylinder 84. When the rod 84*a* is actuated to protrude from the vertical cylinder 84, the lift pins 62 protrude from the hotplate 58, thereby lifting the wafer 14. When the lift pins 62 are retracted into the hotplate 58, the passageways 60 through which the lift pins 62 translate may seal to inhibit the flow of the high thermal conductivity gas through the passageways 60 and out of the gap G. Likewise, sealing the passageways 60 inhibits the flow of air back into the gap G. As with the embodiments above, the seal may be accomplished with the use of an o-ring 108, or any other suitable component utilized for sealing, sealing the annular space between each of the lift pins 62 and the sidewall surrounding the respective passageways 60.

A lid body 128 is provided above the hotplate 58 with an opening at the bottom. The lid body 128 is vertically movable and, in conjunction with the hotplate 58, forms a controlled gaseous environment inside a process space 132. A vent 134 is provided at the top of the lid body 128 to allow the high thermal conductivity gas, supplied to the controlled gaseous environment inside process space 132, as well as any waste product produced from the layer 94 on the front surface 14*a* of the wafer 14 to vent into the gaseous environment inside a process space 126 of the processing chamber 50.

The heat treatment apparatus 130 includes injection ports 124 for supplying a high thermal conductivity gas upward at a plurality of locations at the outer peripheral portion of the hotplate 58. The high thermal conductivity gas, such as hydrogen or helium, displaces air, or other low thermal conductivity gas, in the controlled gaseous environment inside process space 132 of the processing chamber 50, and a predetermined concentration of the high thermal conductivity gas can be maintained therein. In other embodiments, injection ports 124 may be positioned in other locations on the hotplate 58 such as under the wafer 14 directing the high thermal conductivity gas into the gap G.

In this particular embodiment, there is a higher concentration of the high thermal conductivity gas than the air, or other low thermal conductivity gas, in the controlled gaseous environment of the process space 132 inside the processing chamber 50. The higher conductivity gas displaces substantially all of the air in the chamber encompassing the controlled gaseous environment of the process space 132 defined by the lid body 128 and thick plate 71. In other embodiments, lower concentrations of the high thermal conductivity gas in the controlled gaseous environment of the process space 132 inside the processing chamber 50 are possible. However, higher concentrations of the high thermal conductivity gas in the gap G will achieve better thermal conduction between the hotplate 58 and the wafer 14. In an alternate embodiment, the lid body 128 may be omitted. In this embodiment, the high thermal conductivity gas is directly injected into the gaseous environment of the process space 126 surrounding the wafer 14 and gap G. Because the gaseous environment of the process space 126 encompasses the hotplate 58, lift pins 62, arm 80, and vertical cylinder 84, sealing the passageways 60 in the hotplate 58 is optional.

An exhaust port 140 is defined in the cover 122, which communicates with a conduit 142 for exhausting the gaseous environment of the process space 126 in the processing chamber 50 to a vacuum pump 144, or other evacuation unit, that can be throttled to regulate the exhaust rate. The high thermal conductivity gas supplied from the injection ports 124 and impurities or waste product produced from the front-side 14*a* of the wafer 14 are exhausted through the exhaust port 140. Concurrently, a fresh supply of the high thermal conductivity gas may be introduced into the processing chamber 50 at a rate sufficient to replace the exhausted gas. As a result, a gas flow is formed in the gaseous environments of process spaces 126 and 132 of the processing chamber 50 at the time of heating.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. A method for heating a substrate inside a processing chamber, the substrate having a backside, the method comprising:

supporting the substrate in a spaced relationship with a support surface inside the processing chamber with the backside of the substrate separated from the support surface by a heat exchange gap filled by a first gas at approximately atmospheric pressure and peripherally encircled by a side purge ring arranged relative to the support surface;

forming a loose seal between the backside of the substrate and the side purge ring;

introducing a second gas into the heat exchange gap from the side purge ring thereby displacing the first gas from the heat exchange gap, the side purge ring having a plurality of ports oriented radially inward toward the heat exchange gap, the second gas having a higher thermal conductivity than the first gas for increasing thermal conductance between the substrate and the support surface; and transferring heat energy from the support surface through the second gas in the heat exchange gap and to the backside of the substrate for use in heating the substrate.

2. The method of claim 1 further comprising:

heating the support surface to a first temperature above room temperature; and heating the substrate to a second temperature above room temperature with the transferred heat energy.

3. The method of claim 1 further comprising:

partially sealing a perimeter of the heat exchange gap between the backside of the substrate and the ring.

4. The method of claim 1 wherein the second gas comprises at least one of helium or hydrogen, and displacing the first gas from the heat exchange gap further comprises:

directing the second gas comprising at least one of helium or hydrogen to the heat exchange gap.

5. The method of claim 1 wherein the substrate includes a front-side opposite to the backside and a layer of a processable material carried on the front-side, and a process temperature for the processable material ranges from about 90° C. to about 130° C., and transferring heat energy further comprises:

heating the processable material in the layer to the process temperature ranging from about 90° C. to about 130° C.

6. The method of claim 1 wherein the processing chamber contains a gaseous environment composed of the first gas, and further comprising:

displacing the first gas from the gaseous environment with the second gas.

7. The method of claim 6 wherein the substrate carries a layer for thermal processing, and further comprising:

generating a waste product when the layer carried on the substrate is heated to a process temperature; and at least partially removing the waste product from the gaseous environment inside the processing chamber.

8. The method of claim 7 wherein the layer comprises a processable material containing a volatile substance, and the process temperature is sufficient to release the volatile substance as the waste product from the processable material, and generating the waste product further comprises:

transferring heat energy from the backside of the substrate through the substrate to heat the layer to the process temperature; and releasing amounts of the volatile substance from the processable material when the layer is heated to the process temperature.

9. The method of claim 7 wherein at least partially removing the waste product further comprises:

venting a first amount of the second gas to a location outside of the processing chamber to remove amounts of the waste product; and introducing a second amount of the second gas into the processing chamber, while venting, at an introduction rate sufficient to replace the first amount.

10. The method of claim 1 wherein the support surface includes a plurality of support protrusions for supporting the substrate and projecting from the support surface by a height approximately equal to a width of the heat exchange gap, and supporting the substrate further comprises:

supporting the substrate on the support protrusions with the backside of the substrate in a contacting relationship with the support protrusions.

11. The method of claim 10 wherein the support surface includes a plurality of openings and a plurality of lift pins projecting through the openings, and placing the substrate on the support protrusions further comprises:

extending the lift pins through the openings to project above the support surface at a height exceeding the height of the support protrusions;

supporting the substrate on the lift pins with the backside in a contacting relationship with the lift pins; and retracting the lift pins into the openings so that the substrate is lowered toward the support surface and physically transferred from the lift pins to the support protrusions so that the lift pins have a non-contacting relationship with the backside.

12. The method of claim 11 further comprising:

sealing an annular space between each of the lift pins and a respective one of the openings when the lift pins have the non-contacting relationship with the backside.

13. The method of claim 1 wherein supporting the substrate further comprises:

placing the substrate on support protrusions that project from the support surface so that the first gas is trapped in the heat exchange gap.

14. The method of claim 1, wherein the first gas is displaced from the heat exchange gap through the loose seal when the second gas is introduced.

15. The method of claim 1, wherein the second gas is continually introduced into the heat exchange gap to prevent the first gas from re-filling the heat exchange gap through the loose seal.

16. The method of claim 1, wherein the second gas is continually introduced into the heat exchange gap to prevent the first gas from re-filling the heat exchange gap through the loose seal between the substrate and the side purge ring.

* * * * *